US007304254B2

(12) United States Patent
Ma et al.

(10) Patent No.: US 7,304,254 B2
(45) Date of Patent: Dec. 4, 2007

(54) SHOCK ABSORBENT ROLLER THUMB WHEEL

(75) Inventors: Dave M. Ma, Brampton (CA); Herrebertus Tempelman, Princeton (CA); John A. Holmes, Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 11/437,048

(22) Filed: May 19, 2006

(65) Prior Publication Data

US 2006/0207865 A1 Sep. 21, 2006

Related U.S. Application Data

(63) Continuation of application No. 11/005,947, filed on Dec. 7, 2004, now Pat. No. 7,057,120, which is a continuation of application No. 10/410,094, filed on Apr. 9, 2003, now Pat. No. 6,828,518.

(51) Int. Cl.
*H01H 19/58* (2006.01)

(52) U.S. Cl. ..... 200/11 TW; 345/156; 345/184

(58) Field of Classification Search ..... 200/11 TW, 200/61.54, 64.55, 564; 74/552, 553; 341/22, 341/35; 345/156, 157, 184
See application file for complete search history.

(56) References Cited

U.S. PATENT DOCUMENTS 1,509,982 A * 9/1924 Schoeneck et al. ..... 152/86
1,639,827 A 8/1927 Wayne
1,858,723 A * 5/1932 Weaver ..... 152/86
3,811,100 A 5/1974 Schmidt
4,467,495 A 8/1984 Fish et al.
4,553,577 A * 11/1985 Gregg ..... 152/12
5,231,892 A 8/1993 Haight
5,477,508 A 12/1995 Will
5,563,631 A 10/1996 Masunaga
5,574,268 A 11/1996 Herman et al.
5,825,353 A 10/1998 Will
6,008,608 A 12/1999 Holsten et al.
6,392,640 B1 5/2002 Will
6,400,356 B1 6/2002 Bidiville et al.
6,489,950 B1 12/2002 Griffin et al.
6,615,885 B1 9/2003 Ohm

* cited by examiner

*Primary Examiner*—Elvin Enad
*Assistant Examiner*—M. Fishman
(74) *Attorney, Agent, or Firm*—Jones Day; Krishna K. Pathiyal; Robert C. Liang

(57) ABSTRACT

A shock absorbing roller thumb wheel is disclosed. The shock absorbing thumb wheel includes a central hub that can be secured to an electro-mechanical switch, a rim encircling the central hub, and force dispersion spokes extending from the central hub and connected to the rim. The configuration of the force dispersion spokes and the resilient material of the force dispersion spokes and the rim allow for radial and lateral deflection of the rim in response to an applied impact force. The impact force is thereby at least partially absorbed by the radial and lateral deflection of the rim and spokes, such that less impact force is transferred to connections between the electro-mechanical switch and any assembly to which the switch is attached. Hence, the probability of connection failures is reduced, and the lifetime of a device that uses the thumb wheel can be extended.

30 Claims, 8 Drawing Sheets

SHOCK ABSORBENT ROLLER THUMB WHEEL

CROSS-REFERENCE TO RELATED APPLICATION

This application is a continuation of U.S. application Ser. No. 11/005,947, filed Dec. 7, 2004, now U.S. Pat. No. 7,057,120, which is a continuation of U.S. application Ser. No. 10/410,094, filed Apr. 9, 2003, now U.S. Pat. No. 6,828,518, the disclosures of which are incorporated herein by reference in their entirety.

FIELD

This disclosure generally relates to roller thumb wheels for electronic devices.

BACKGROUND

Many mobile electronic devices such as personal digital assistants, cell phones, and other wireless devices utilize various input means for allowing a user to select or execute functions upon the device. Such input means can include keyboards for entering alpha-numeric text, dedicated function buttons, directional keypad buttons and roller thumb wheels.

Roller thumb wheels are desirable since they permit single-handed operation of the device. In particular, the thumb wheel is placed at a position on the device such that the user can actuate the thumb wheel with a thumb while holding the device in the palm of their hand. The thumb wheel can be rolled to highlight an icon displayed on an LCD panel of the device and depressed to select the highlighted icon. Roller thumb wheels can be positioned on a device for left or right handed operation, and they protrude from the device.

When the mobile device is accidentally dropped, the impact can occur at the protruding rolling thumb wheel. The impact force applied to the thumb wheel can damage an assembly the thumb wheel is attached to, rendering the mobile device unusable. More specifically, the impact force can cause the thumb wheel assembly to break off a printed circuit board or other device element to which it is attached.

There exists, therefore, a need for a thumb wheel that can absorb impact damaging loads and minimize damage to elements or assemblies to which it is coupled.

SUMMARY

In a first aspect, the present example provides a shock absorbing roller thumb wheel for actuating an electromechanical switch, comprising a hub for attachment to the switch, a resilient outer rim encircling the hub, and force dispersion spokes connecting the resilient outer rim to the hub, each force dispersion spoke having a predetermined length and cross-sectional shape for radially and laterally deforming in response to an impact force applied to the resilient outer rim.

In a second aspect, the present example provides a mobile device comprising an LCD panel for displaying information and a shock absorbing roller thumb wheel for actuating an electromechanical switch and changing the display information on the LCD panel. The shock absorbing roller thumb wheel comprises a hub for attachment to the switch, a resilient outer rim encircling the hub, and force dispersion spokes for connecting the resilient outer rim to the hub, each force dispersion spoke having a predetermined length and cross-sectional shape for radially and laterally deforming in response to an impact force applied to the resilient rim.

DETAILED DESCRIPTION

A shock absorbing roller thumb wheel is disclosed. The shock absorbing thumb wheel includes a central hub that can be secured to an electromechanical switch, a rim encircling the central hub, and force dispersion spokes extending from the central hub and connected to the rim. The configuration of the force dispersion spokes and the resilient material of the force dispersion spokes and the rim allow for radial and lateral deflection of the rim in response to an applied impact force. Therefore, as an impact force is absorbed by the radial and lateral deflection of the rim and spokes, less impact force is transferred to solder joints connecting the electromechanical switch to a printed circuit board, such as in a typical switch installation. Hence, the probability of solder joint failures is reduced, and the lifetime of the device that uses the thumb wheel can be extended.

Figure 1:
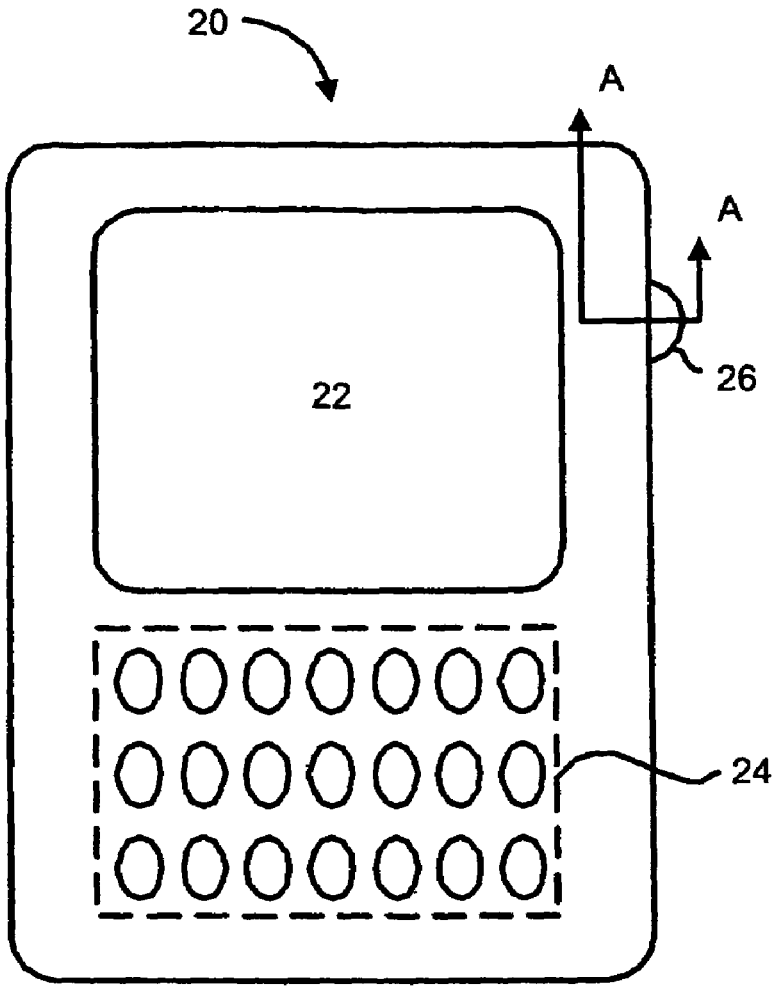
FIG. 1 is a block diagram of a mobile device having a rolling thumb wheel.

FIG. 1 is a block diagram of a mobile device having a roller thumb wheel. The device 20 includes an LCD display area 22 for displaying information, a keypad area 24 having at least one function button, and a thumb wheel 26 protruding from the right side of the device. Some electronic devices do not require a keypad area 24 for inputting information. Thumb wheel 26 can be connected to an electromechanical switch via ultrasonic welds or heat stakes (not shown), which is itself typically connected to a printed circuit board via solder joints. Those of skill in the art will understand that LCD display area 22 can display information such as application icons and menu items. Through actuation of thumb wheel 26, the electromechanical switch changes the information displayed on LCD display area 22, by highlighting a particular menu item or application icon, for example. Those of skill in the art will understand that actuation of thumb wheel 26 can affect various types of LCD display changes as the signals from the electromechanical switch are converted or decoded into predetermined actions by a processor in device 20. The mobile device 20 may, for example, be a wireless mobile data communication device, a personal digital assistant (PDA), a mobile telephone with or without data communication functionality, or a one-way or two-way pager.

Figure 2:
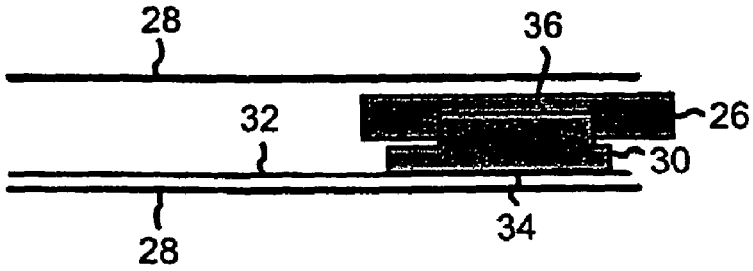
FIG. 2 is a cross-sectional diagram of the electronic device shown in FIG. 1 along line A-A.

FIG. 2 shows a cross-sectional diagram of device 20 along line A-A to show the thumb wheel assembly. FIG. 2 shows casing 28 of device 20, thumb wheel 26, electro-mechanical switch 30, and printed circuit board 32. Printed circuit board 32 is attached to casing 28, and electro-mechanical switch 30 is soldered to printed circuit board 32 at solder area 34. Thumb wheel 26 can be ultrasonically welded to electro-mechanical switch 30 at weld area 36.

Figure 3:
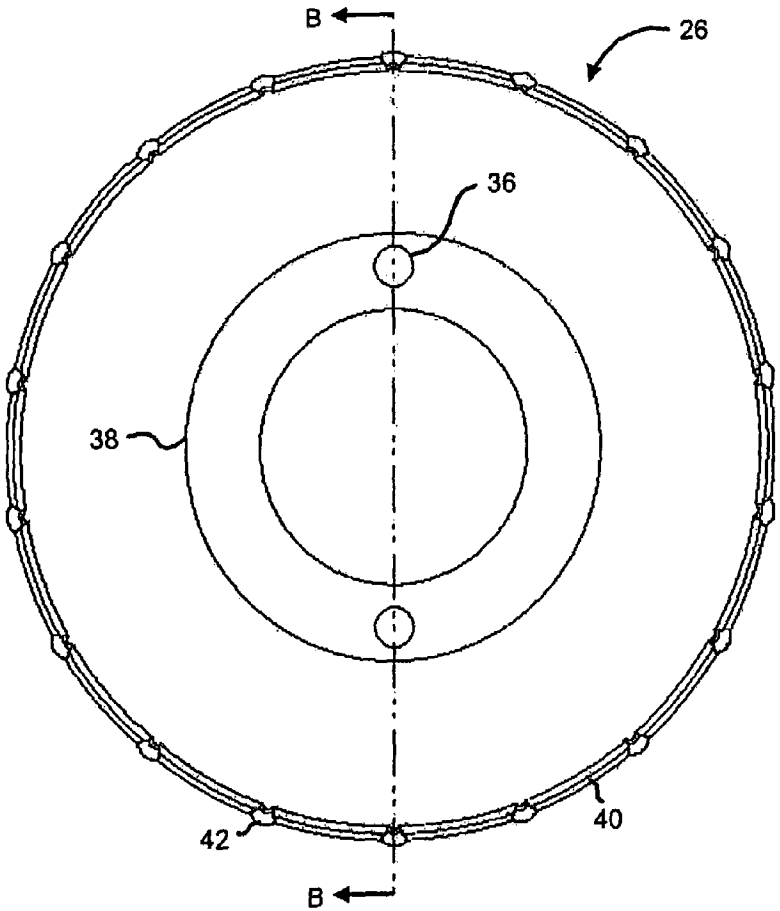
Figure 3 (Prior Art)
FIG. 3 is frontal view of a known rolling thumb wheel.

FIG. 3 is a frontal view of a conventional thumb wheel 26. Thumb wheel 26 is typically formed as a disc of plastic material. Weld areas 36 are shown as two circular holes in the hub area 38 of thumb wheel 26. Weld areas 36 are shaped to receive protrusions extending from the electromechanical switch (not shown) to anchor the thumb wheel 26 and ensure that rotational movement of the thumb wheel 26 is transferred to the electromechanical switch. An outer rim 40 encircles the hub area 38, which is connected to the hub area 38 with the plastic material. Knurls 42 formed on the surface of outer rim 40 facilitates rotation of thumb wheel 26 by the user.

Figure 4:
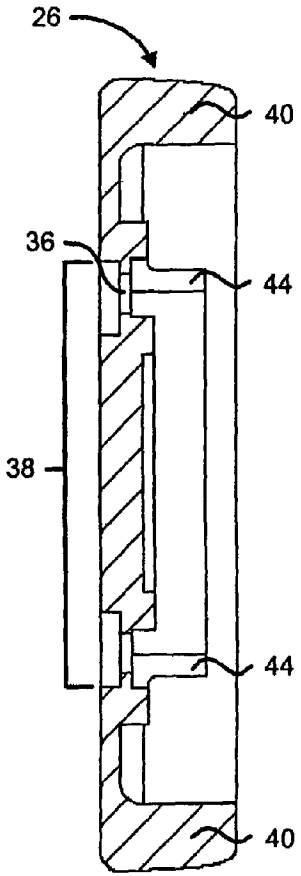
Figure 4 (Prior Art)
FIG. 4 is a cross-sectional diagram of the thumb wheel of FIG. 3 along line B-B.

FIG. 4 is a cross-section of thumb wheel 26 of FIG. 3 along line B-B to show the relative dimensions of thumb wheel 26. Rim 40 has a predetermined thickness and depth, and is joined to the hub area 38 by the material. A circular shroud 44 extends from the hub area to further anchor and stabilize thumb wheel 26 onto the electromechanical switch 30. Thus, when thumb wheel 26 is secured to the electro-mechanical switch 30, a user can actuate the electromechanical switch 30 by rotating thumb wheel 26 with a thumb or finger.

Since thumb wheel 26 protrudes from the casing of device 20, it can be damaged when device 20 is accidentally dropped upon a hard surface and the impact point occurs at thumb wheel 26. More specifically, any impact upon thumb wheel 26 can cause the electromechanical switch 30 to break off the printed circuit board. This is due to the fact that the full impact force experienced by the thumb wheel 26 is transferred to solder area 34, with sufficient strength to break the solder joints. The ultrasonic welds between the thumb wheel 26 and the electromechanical switch 30 have a much higher resistance to failure than the solder joints, which is why most failures occur at the weaker solder joints. In certain cases, the solder joints might not be fractured after impact, but sufficiently weakened to the point where they can fail under normal use. When the electromechanical switch 30 is electrically separated from the printed circuit board, device 20 is considered damaged and effectively unusable since many features accessible using the thumb wheel 26 are no longer available to the user.

Figure 5:
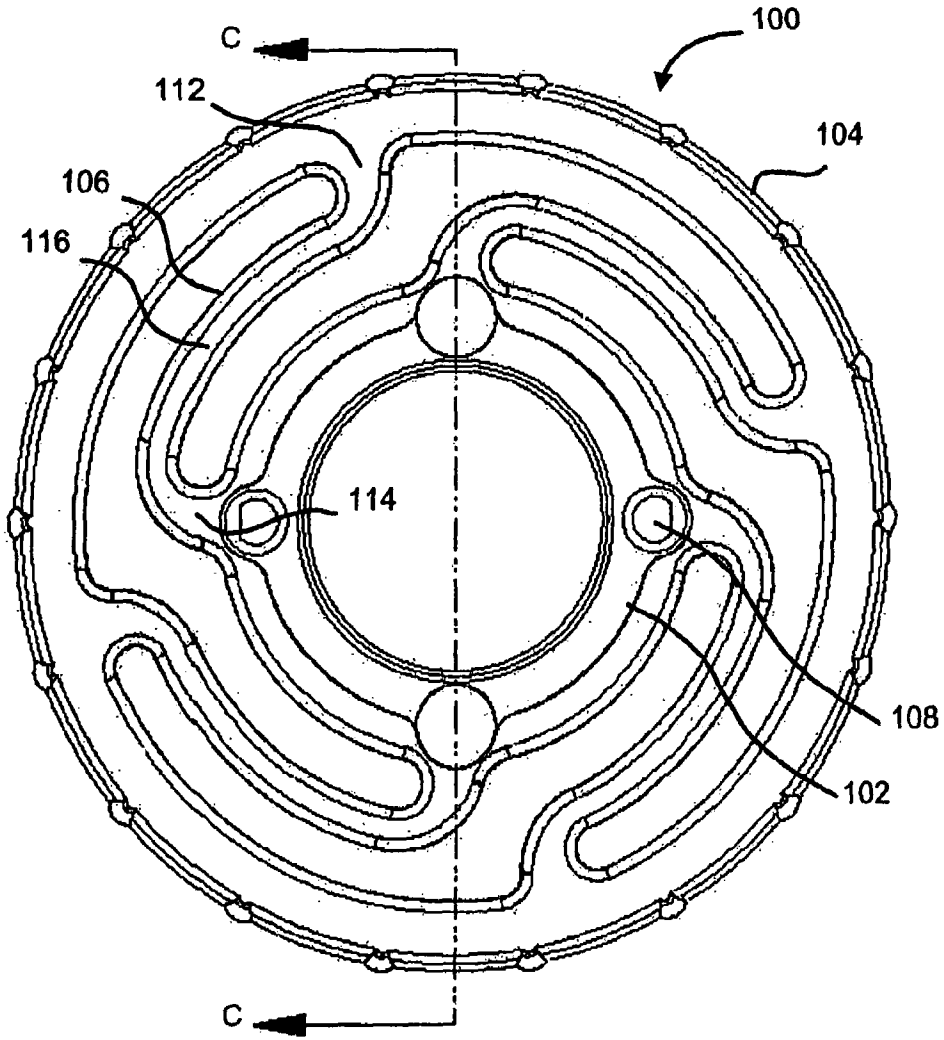
FIG. 5 is a frontal view of a shock absorbing rolling thumb wheel according to an embodiment of the present example.

FIG. 5 is a diagram of a shock absorbing rolling thumb wheel according to an embodiment of the present example. Thumb wheel 100 can be used in place of conventional thumb wheel 26 of FIG. 3. Thumb wheel 100 includes a substantially circular hub 102, an outer rim 104 encircling hub 102 having an outer shape, and four force dispersion spokes 106 each having a spoke body 116 extending from hub 102 and connecting rim 104 to hub 102, with at least part of the spoke body 116 having a contour that is arranged parallel to the outer surface or shape of the inner hub 102. As shown in FIG. 5, a majority of the length of the spoke body 116 is parallel to the outer surface or shape of the inner hub 102.

Formed within hub 102 are weld areas 108 for receiving protrusions from an electro-mechanical switch. Weld areas 108 are substantially the same as weld areas 36 shown for the standard thumb wheel 26 shown in FIG. 3. Thumb wheel 100 can be molded using techniques well-known to those of skill in the art, with any resilient plastic material such as Lexan™ EXL9330 by GE, Zytel™ ST801HSBK010 by Dupont, Zytel™ ST801AHSBK010 by Dupont, and PA-46 nylon, for example. Rim 104 can have any suitable, preferably knurled, surface.

Force dispersion spokes 106 are generally "S" shaped between the outer rim 104 and hub 102, with the ends of the spokes being connected to the rim and the hub via spoke-rim joints 112 and spoke-hub joints 114 respectively. The main spoke body 116 is formed as an arc about center of hub 102. Since the spoke body 116 is formed as an arc it is inherent continuous curved. The main spoke body has a constant width, but the ends are slightly widened to provide additional structural support to the spoke-hub joint 114 and the spoke-rim joint 112.

Figure 6:
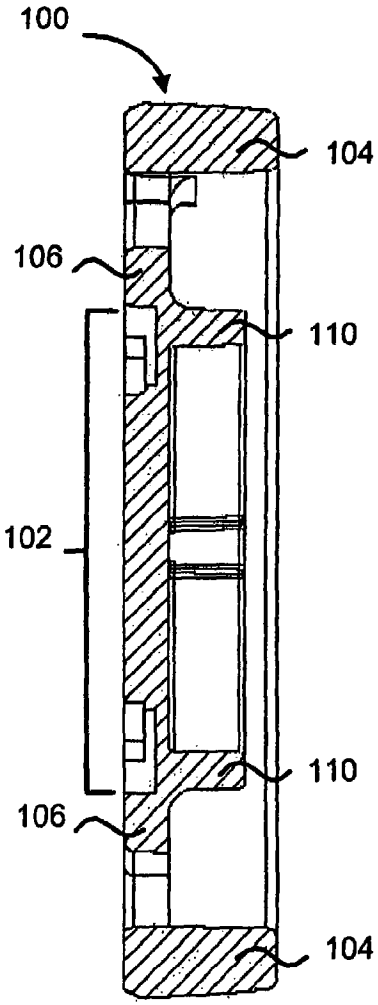
FIG. 6 is a cross-sectional diagram of the shock absorbing rolling thumb wheel of FIG. 5 taken along line C-C.

FIG. 6 is a cross-section diagram of shock absorbing thumb wheel 100 of FIG. 5 along line C-C to show the relative dimensions of its components. The same numbered elements have been previously described in the discussion of FIG. 5. It is noted that the cross-section of shock absorbing thumb wheel 100 is similar to that of standard thumb wheel 26 shown in FIG. 4, except for the spaces between rim 104 and hub 102 that show the absence of material between them in a radial direction. A circular shroud 110 extends from hub 102 for performing the same function as shroud 44 of FIG. 4.

Force dispersion spokes 106, referred to as spokes from this point forward, can radially deform along the same plane defined by hub 102 and laterally deform away from the hub plane, along a direction perpendicular to the hub plane, for example. Rim 104, being of the same resilient material as spokes 106, can itself deform radially in the areas between adjacent spoke contact areas since there is no material between it and the hub to resist deformation. The "S" shaped configuration of spokes 106 allows for compression deformation and expansion deformation since its material is resilient, making it behave similarly to a leaf spring along the radial direction. The thickness and length of each spoke 106 also determines its stiffness in the lateral direction, and consequently, the amount of force it can absorb. The overall length, width, depth, shape and cross-sectional shape of each spoke 106 is preferably optimized to absorb a predetermined maximum impact force, which will depend upon the mass of the device it is to be installed within. For example, a preferred design ensures that the spokes do not fully compress, or "bottom out", under a force that is less than the maximum rated impact force. However, even if the spokes do fully compress and the remaining impact force is transferred to the solder joints between the printed circuit board and the electro-mechanical switch, this remaining force should be insufficiently strong to break the solder joints.

Under an impact force applied to the outer rim 104 along the same plane defined by the hub 102 and outer rim 104, the resilient outer rim 104 deforms, and the spokes 106 near the area of impact radially deform under compression. At the same time, some of the spokes 106 radially deform under tension. If the impact force is applied from a direction lateral to the hub and rim plane, i.e. perpendicular to the hub, the spokes deform laterally. Therefore, spokes 106 deform radially to absorb a radial component of an impact force, while they can simultaneously deform laterally to absorb a lateral component of the impact force. Hence the damaging impact force is substantially prevented from reaching and damaging the solder joints securing the electro-mechanical switch to the printed circuit board.

Figure 7:
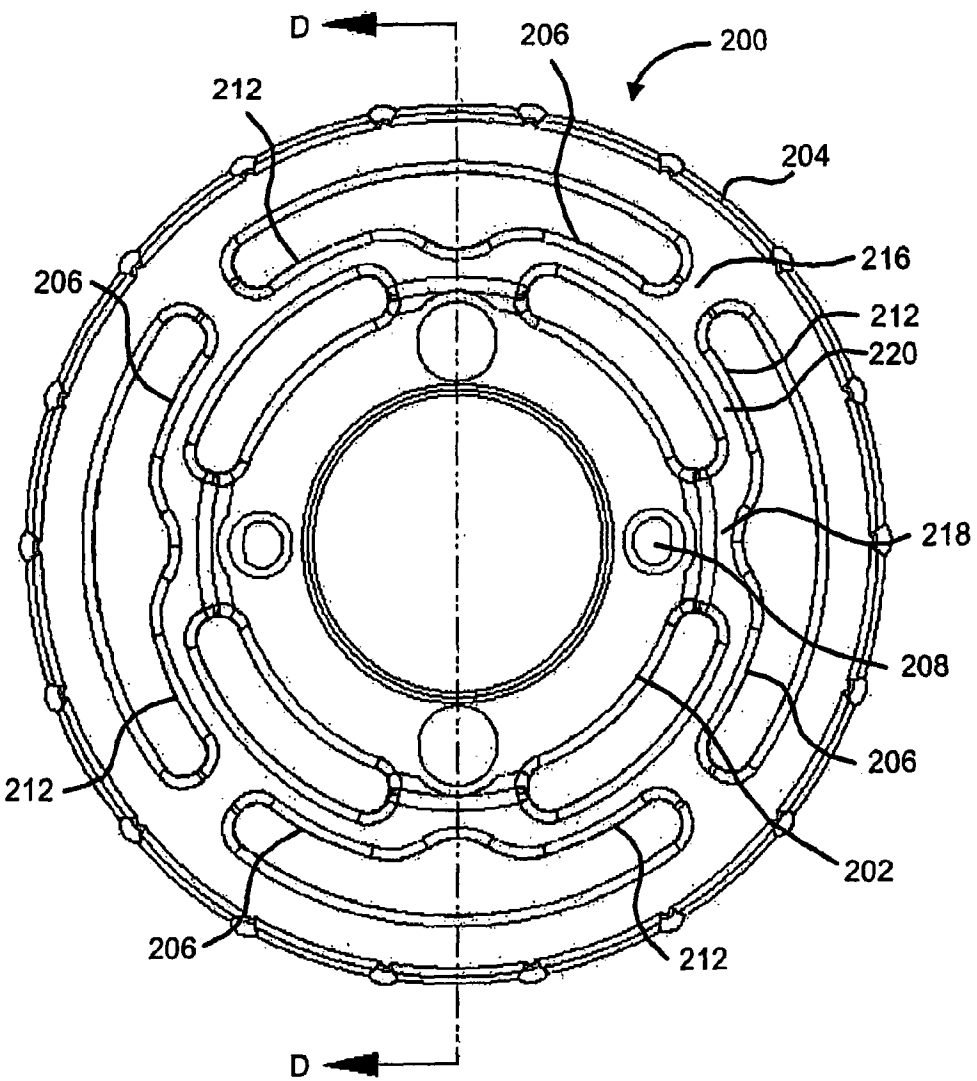
FIG. 7 is a frontal view of a shock absorbing rolling thumb wheel according to another embodiment of the present example.

FIG. 7 is a diagram of a shock absorbing rolling thumb wheel according to another embodiment of the present example. Thumb wheel 200 is stiffer radially and laterally than thumb wheel 100 to absorb a greater maximum amount of impact force. Thumb wheel 200 is similarly configured to thumb wheel 100 shown in FIG. 5, and includes a substantially circular hub 202, an outer rim 204 having a knurled surface encircling hub 202, and spokes 206/212 extending from hub 202 and connected to rim 204. Formed within hub 202 are weld areas 208 for receiving protrusions from an electro-mechanical switch. Thumb wheel 200 can be molded in the same way thumb wheel 100 is molded, and with the same previously listed materials. The outer rim 204 is substantially the same as outer rim 104 of FIG. 5. Shock absorbing thumb wheel 200 includes enhancements over shock absorbing thumb wheel 100 that increase the overall stiffness of thumb wheel 200 over thumb wheel 100, and therefore the maximum impact force that it can absorb.

Shock absorbing thumb wheel 200 of FIG. 7 now includes a total of eight spokes connected between hub 202 and outer rim 204. Spokes 206 are configured essentially the same as spokes 106, except that their main bodies 220 are shorter in length. Additional spokes 212 that mirror the shape of spokes 206 also connect hub 202 to outer rim 204. More specifically, spokes 206 extend from the hub 202 towards the outer rim 204 in a clockwise direction, and the additional spokes 212 extend from the hub 202 towards the outer rim 204 in a counter-clockwise direction. Each pair of spokes 206 and 212 that extend towards each other from hub 202 share the same spoke-rim joint 216. Accordingly, each pair of spokes 206 and 212 that extend away from each other from hub 202 share the same spoke-hub joint 218.

Figure 8:
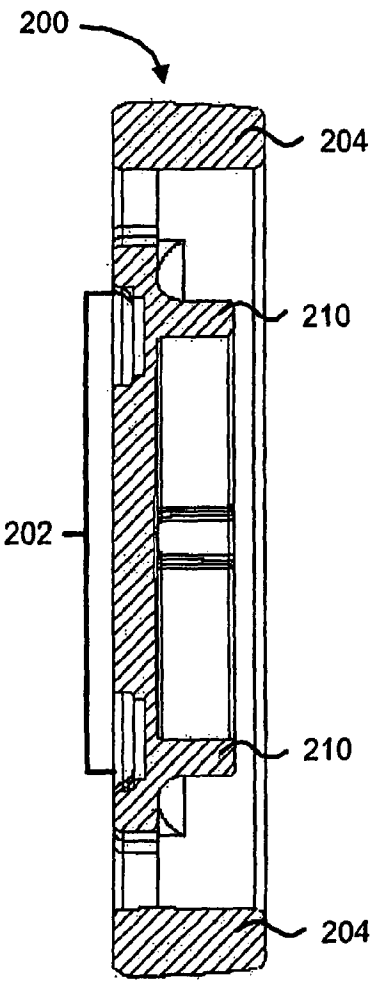
FIG. 8 is a cross-sectional diagram of the shock absorbing rolling thumb wheel of FIG. 7 taken along line D-D.

FIG. 8 is a cross-sectional diagram of shock absorbing thumb wheel 200 of FIG. 7 along line D-D to show the relative dimensions of its components. The same numbered elements have been previously described in the discussion of FIG. 8. It is noted that the cross-section of shock absorbing thumb wheel 200 is similar to that of shock absorbing thumb wheel 100 shown in FIG. 5. A circular shroud 210 extends from hub 202 for performing the same function as shroud 110 of FIG. 6.

In the present example, it is assumed that the material and cross-sectional dimensions of thumb wheel 100 are the same as thumb wheel 200. However, the spokes 206 and 212 of thumb wheel 200 will be stiffer radially and laterally than spokes 106 of thumb wheel 100 due mainly to the shorter main body length of spokes 206 and 212, and the fact that each common spoke-rim joint 216 is connected to two spokes instead of one. Although the total number of spoke-rim joints 216 formed in thumb wheel 200 is the same as for thumb wheel 100, each spoke-rim joint of thumb wheel 200 is supported by two spokes. Furthermore, the shared spoke-hub joints 218 are highly resistant to lateral deformation due to their relatively large size. Therefore, shock absorbing thumb wheel 200 can disperse or absorb a greater maximum lateral impact force than shock absorbing thumb wheel 100 shown in FIG. 5.

The thumb wheel 200 absorbs different amounts of impact force in the radial direction, depending upon where the impact force is applied. For example, if the impact force is applied to the outer rim 204 near the spoke-rim joint 216, then a relatively large amount of the impact force is absorbed, as spoke pair 206/212 connected to common spoke-rim joint 216 deform to absorb the impact force. On the other hand, if the impact force is applied to the outer rim 204 between adjacent spoke-rim joints 216, then a relatively small amount of the impact force is absorbed since only the outer rim 204 deforms.

Figure 9:
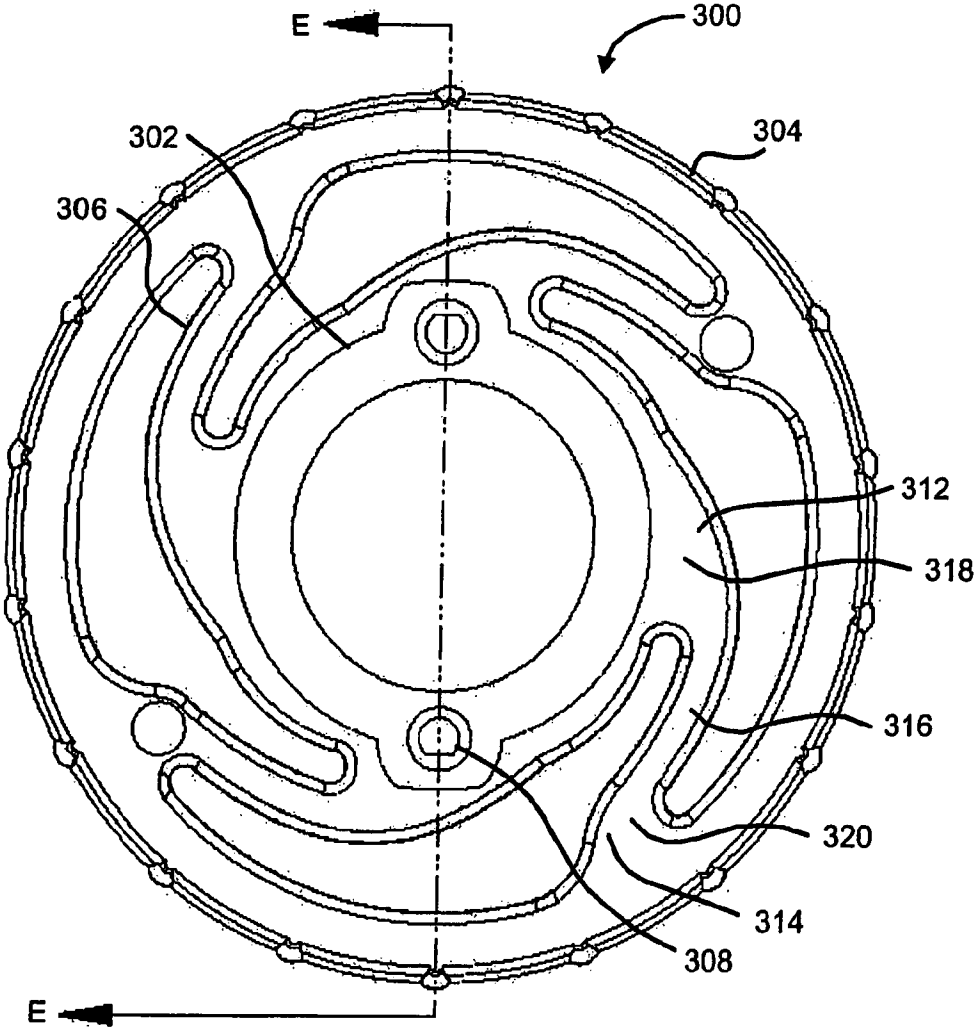
FIG. 9 is a frontal view of a shock absorbing rolling thumb wheel according to another embodiment of the present example.

FIG. 9 is a diagram of a shock absorbing rolling thumb wheel according to another embodiment of the present example. Shock absorbing thumb wheel 300 of FIG. 9 is stiffer than thumb wheel 200 of FIG. 7 to absorb a greater maximum impact force. Thumb wheel 300 is similarly configured to thumb wheel 100 shown in FIG. 5. Thumb wheel 300 includes a substantially circular hub 302, an outer rim 304 having a knurled surface encircling hub 302, and four spokes 306 extending from hub 302 and connecting rim 304 to hub 302. Formed within hub 302 are weld areas 308 for receiving protrusions from an electromechanical switch. Thumb wheel 300 can be molded in the same way the previously described thumb wheels 26, 100 and 200 are molded, and with the same materials previously listed. The outer rim 304 is substantially the same as outer rim 104 of FIG. 5. The configuration of spokes 306 will now be described in further detail.

Spokes 306 extend substantially tangentially from huh 302 towards rim 304, or more specifically, spokes 306 extend away from hub 302 to increase its stiffness in the radial direction. This design allows the spokes 306 to absorb a greater maximum radial impact force than spokes 106 of FIG. 5. As shown in the embodiment of FIG. 9, spokes 306 are curved in a general "S" shape with the ends of the spokes being connected to the rim and the hub respectively in the same manner as spokes 106 of FIG. 5. While the width of each spoke 306 is constant over the length of its main body 316, its spoke-hub joint 318 and spoke-rim joint 320 are significantly wider due to the addition of joint reinforcements. In particular, spoke 306 includes a hub shoulder reinforcement 312 at its spoke-hub joint and a rim shoulder reinforcement 314 at its spoke-rim joint. Both reinforcements 312 and 314 add structural strength to the spokes, and increase its resistance to radial and lateral deformation in those areas. In particular, hub shoulder reinforcement 312 and rim shoulder reinforcement 314 augment stiffness of the spokes 306 as it undergoes compression. Therefore, shock absorbing thumb wheel 300 can disperse or absorb a greater maximum impact force than shock absorbing thumb wheel 100 shown in FIG. 5.

An additional force dispersion feature of shock absorbing thumb wheel 300 not found in thumb wheels 100 and 200 is the rotational reaction of hub 302 in response to an impact force. Due to the substantial tangential shape of spokes 306 relative to hub 302, hub 302 will rotate under the impact force to disperse an additional amount of the impact force. Furthermore, shock absorbing thumb wheel 300 shown in FIG. 9 has been designed to absorb approximately the same amount of radial impact force regardless of the point of impact along outer rim 304. Therefore, the overall radial force dispersion performance of shock absorbing thumb wheel 300 is better than shock absorbing thumb wheel 200 shown in FIG. 7. While shock absorbing thumb wheel 300 has been shown with force dispersion spokes extending away from the hub in a clockwise direction, they can also extend away from the hub in a counter-clockwise direction in an alternative embodiment.

Figure 10:
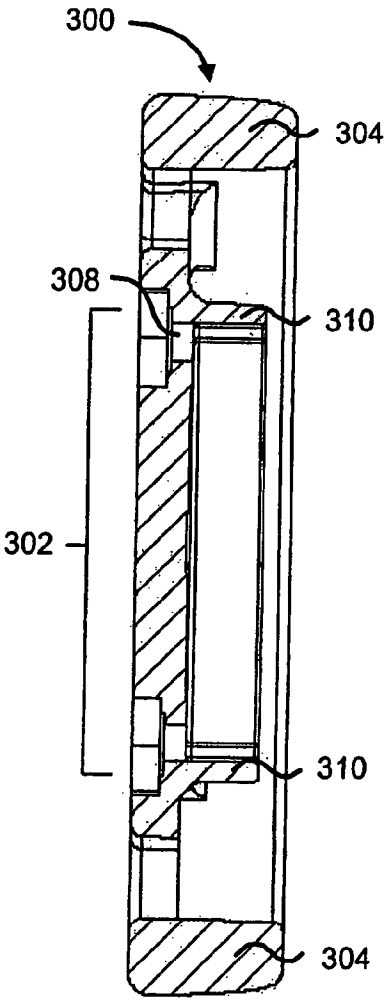
FIG. 10 is a cross-sectional diagram of the shock absorbing rolling thumb wheel of FIG. 9 taken along line E-E.

FIG. 10 is a cross-section of the shock absorbing thumb wheel 300 of FIG. 9 along line E-E to show the relative dimensions of its structures. It is noted that the cross-section of shock absorbing thumb wheel 300 is similar to that of shock absorbing thumb wheels 100 and 200. In alternative embodiments of the present example, the thickness of the spokes 306 can be increased to absorb higher amounts of lateral impact force. A circular shroud 310 extends from hub 302 for performing the same function as shrouds 110 and 210 in FIGS. 6 and 8.

As shown in the embodiments of the present example, the spokes of the shock absorbing thumb wheel do not extend radially between the hub and the outer rim. In other words, the spoke-hub joint and the spoke-rim joint of the spokes do not lie on the same radius of the thumb wheel. In the shock absorbing thumb wheel embodiment shown in FIGS. 5 and 7, the spoke-hub and spoke-rim joints are formed at non-opposing circumferential positions and in a predetermined size such that the spoke main body can be formed as an arc about the center of the hub. The main body of the spokes is not limited to an arc shape, as shown in the shock absorbing thumb wheel embodiment of FIG. 9. The spoke-hub and spoke-rim joints of the spokes of FIG. 9 are formed such that the spoke main body extends away from the hub. As previously described, the dimensions of the spoke, its shape and the material used determine the amount of force the thumb wheel of the present example can absorb radially and laterally. Preferably, the shock absorbing thumb wheel is designed to be sufficiently stiff to impart the "click" feedback sensation to users once they have pressed the shock absorbing thumb wheel to make a selection. These design specifications will be determined in large part by the size and dimensions of the mobile device, and the desired size of the thumb wheel.

Figure 11:
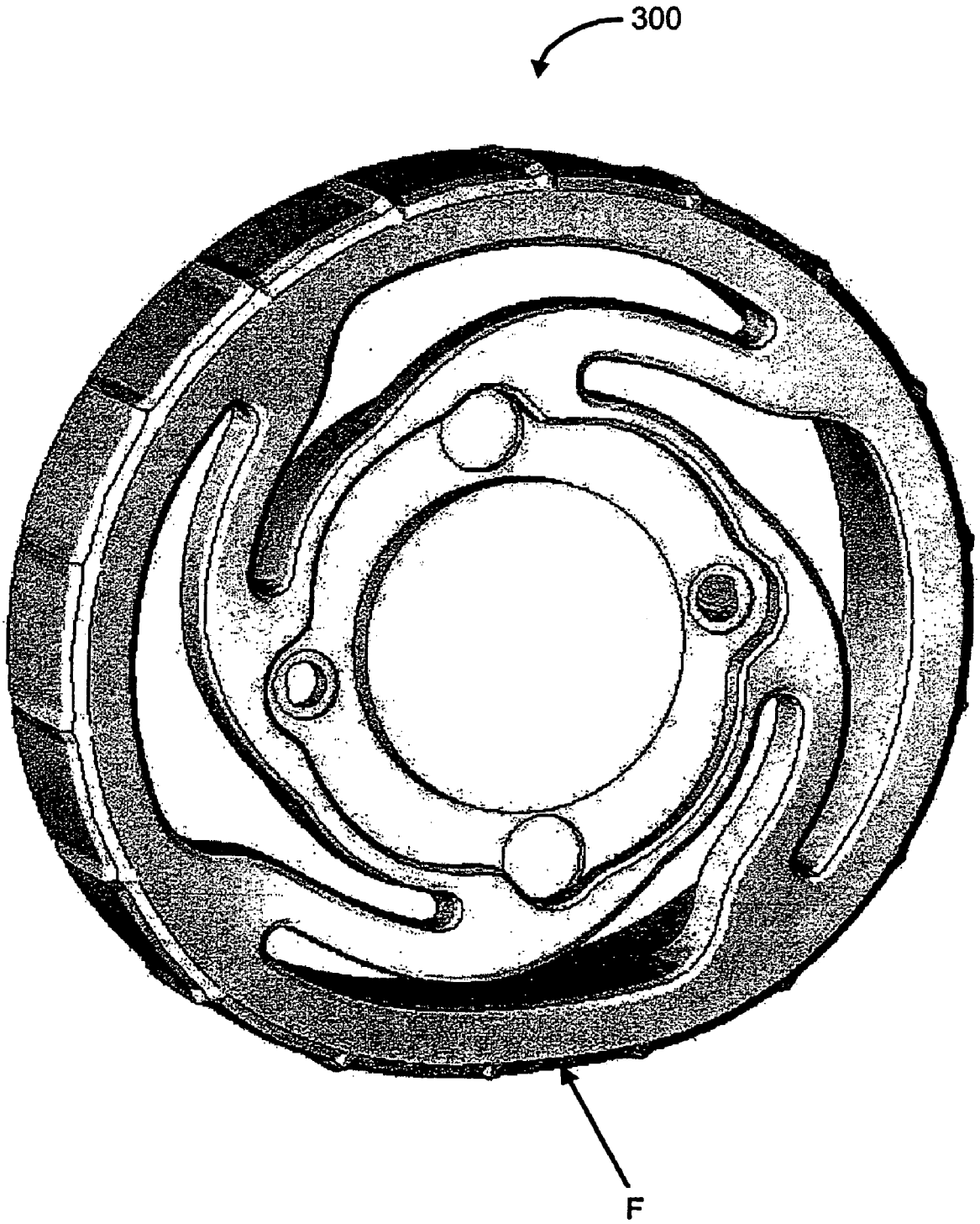
FIG. 11 is an orthogonal view of the shock absorbing rolling thumb wheel of FIG. 9 subjected to an impact force.
Figure 12:
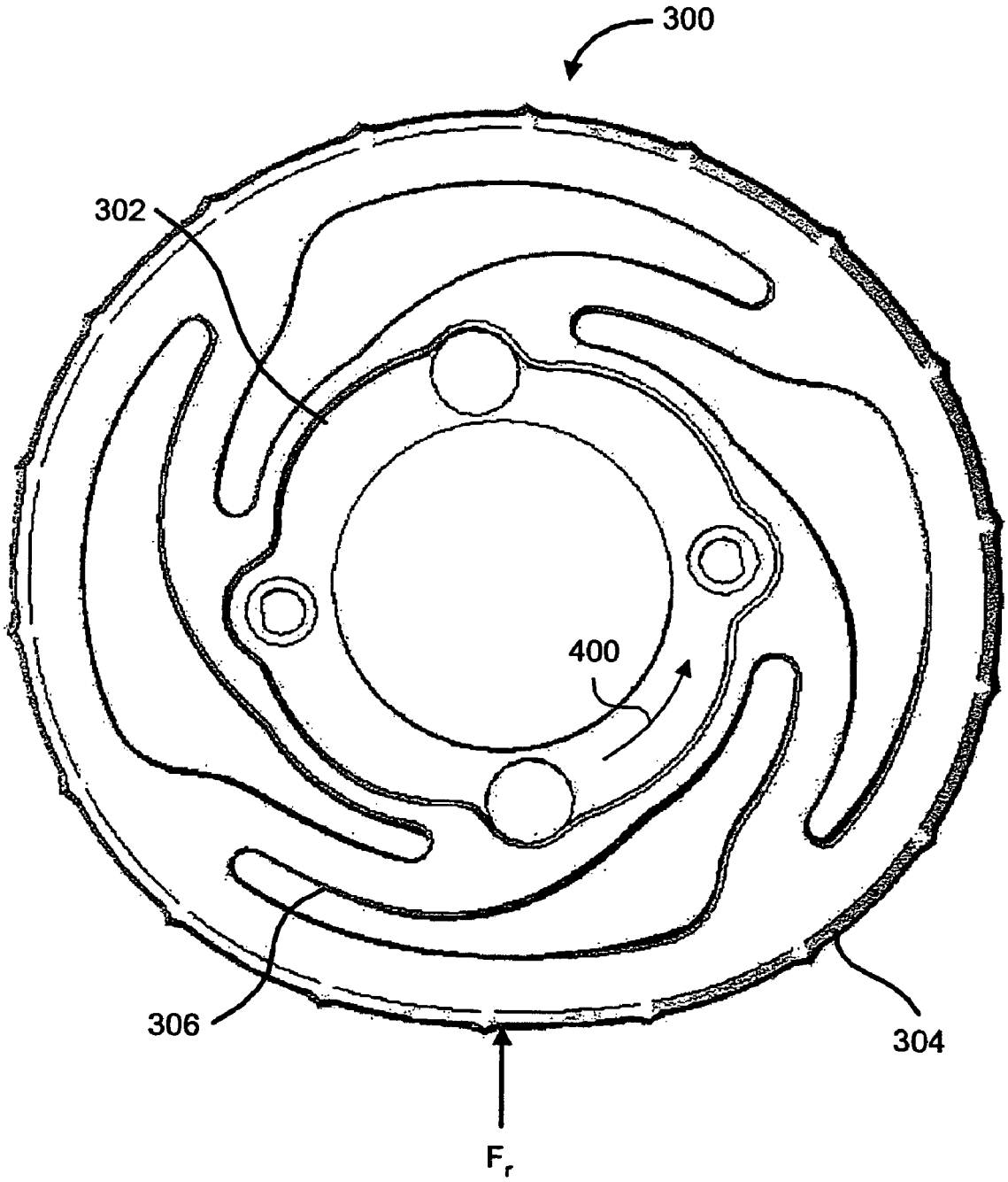
FIG. 12 is a frontal view of the shock absorbing rolling thumb wheel of FIG. 11; and, FIG. 13 is a side view of the shock absorbing rolling thumb wheel shown in FIG. 11.
Figure 13:
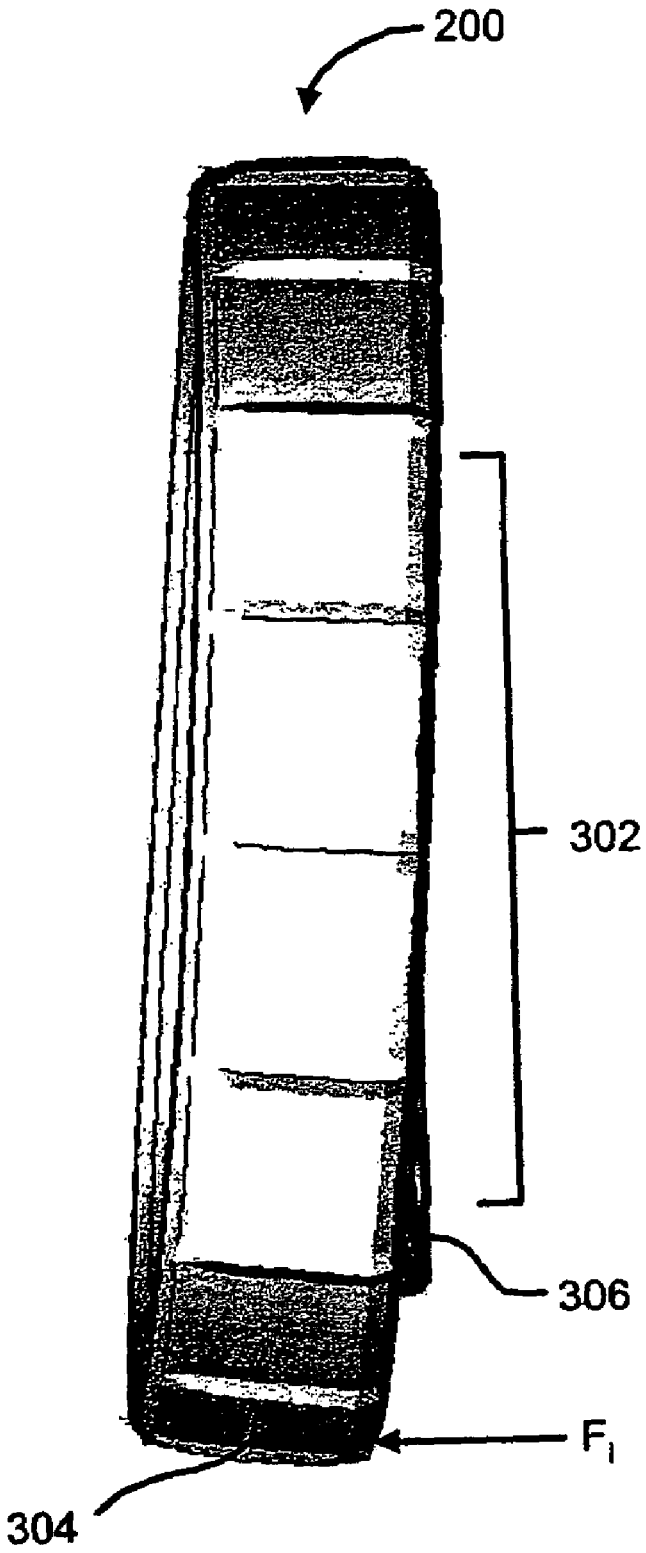

FIGS. 11 to 13 illustrate the behavior of the shock absorbing thumb wheel 200 of FIG. 7 in response to an applied impact force vector F. FIG. 11 shows an orthogonal diagram of shock absorbing thumb wheel 300 under deformation in response to impact force vector F which is applied at an oblique angle to the bottom of thumb wheel 300. It is assumed that impact force vector F simulates a hard flat surface that the thumb wheel 300 has struck after accidental droppage. The outer rim of thumb wheel 300 deforms both radially and laterally, as shown in FIGS. 12 and 13 and described below, since impact force vector F has radial and lateral components.

FIG. 12 shows a frontal view of thumb wheel 300 of FIG. 11 under radial deformation caused by the radial component of impact force vector F, labeled Fr. Although the outer rim 304 has deformed, spoke 306 has also deformed such that its main body bends towards hub 302. As spoke 306 bends towards hub 302, hub is 302 is forced to rotate in a counter-clockwise direction as indicated by rotation vector 400. The degree of this rotation is limited to a few degrees in the present configuration of thumb wheel 300, but sufficient to absorb more of impact force Fr. The remaining spokes 306 also undergo some compression and tension to absorb impact force Fr. Therefore, outer rim 304 and spokes 306 cooperate to absorb a majority of the impact force Fr.

FIG. 13 shows a side view of thumb wheel 300 of FIG. 11 under lateral deformation caused by the lateral component of impact force vector F, labeled F1. As shown in FIG. 13, outer rim 304 has been displaced relative to hub 302, and has itself deformed laterally under F1. It should be noted that spoke 306 has deformed laterally to allow outer rim 204 to laterally displace, and the portion showing is actually the spoke-hub joint 318 of spoke 306 which is more resistant to lateral deformation than its main body.

Any impact force experienced by thumb wheel 300 is therefore at least partially absorbed to minimize the impact force experienced by the solder joints between the electro-mechanical switch and printed circuit board. Hence, the electromechanical switch is more likely to remain functional after direct accidental impacts upon the thumb wheel attached to it.

The embodiments of the shock absorbing thumb wheel shown in FIGS. 5 to 10 absorb or disperse a significant portion of an impact force applied to their outer rims to limit the amount of force transferred to the solder joints securing the electro-mechanical switch to the printed circuit board. The spokes extending from the hub and connecting to the outer rim of the thumb wheel dampen the impact force applied to the solder joints through its radial and lateral deformation. The spokes are optimized with preset yield points to resist permanent deformation or breakage under the maximum rated impact force. Furthermore, the spokes can themselves deform laterally and radially since there is a minimal amount of material connecting the outer rim to the hub to resist deformation. Hence, additional shock absorption can be realized. Therefore a mobile device employing a shock absorbent thumb wheel according to the embodiments of the present example is less likely to suffer a solder joint failure between its electro-mechanical switch and printed circuit board under normal accidental impact conditions.

The embodiments of the shock absorbing thumb wheel shown in the figures have gates, or injection molding artifacts, that indicate the point of injection for the mold. Those of skill in the art will understand that these gates can be located at any location, but are preferably located in the hub area.

Those of skill in the art will also understand that the shock absorbing thumb wheel of the present invention can be manufactured with different resilient materials, as mentioned earlier, where the selection of the particular material, physical geometry and dimensions of the shock absorbing thumb wheel will determine the maximum desired impact force it can absorb.

The above-described embodiments of the invention are intended to be examples of the present invention. Alterations, modifications and variations may be effected on the particular embodiments by those of skill in the art, without departing from the scope of the invention which is defined solely by the claims appended hereto.

We claim:

1. A thumbwheel for use with a mobile device comprising:

an outer rim;

an inner hub having a center and an outer surface; and a plurality of spokes extending between the outer rim and the inner hub, with each spoke including a spoke/rim joint and a spoke/hub joint that are not radially aligned with one another, and with each spoke further including a continuously curved spoke body formed as an arc about the center of the inner hub.

2. The thumbwheel of claim 1, wherein the spoke body has a constant width, and the spoke/rim joint and the spoke/hub joints are wider than the spoke body.

3. The thumbwheel of claim 1, wherein the outer rim is resilient and the plurality of spokes are resilient.

4. The thumbwheel of claim 1, wherein the spokes are deformable in both a radial and a lateral direction relative to the outer surface of the hub.

5. The thumbwheel of claim 1, wherein each spoke has a length, width, depth, and shape that is designed to absorb a predetermined maximum impact force.

6. The thumbwheel of claim 1, wherein each spoke has a first and a second sidewall, with the first sidewall being positioned farthest from the outer surface of the hub and the second side wall being positioned closest to the outer surface of the hub, with each of the first and second sidewalls having at least one of a portion that is parallel to the outer surface of the hub and a portion that is positioned in a non-radial plane.

7. The thumbwheel of claim 1, wherein each spoke has a first and a second sidewall, with the first sidewall being positioned farthest from the outer surface of the hub and the second side wall being positioned closest to the outer surface of the hub, with each of the first sidewalls extending substantially tangentially from the hub outer surface.

8. The thumbwheel of claim 1, wherein each of said spokes is sized and shaped to absorb a force that is greater than a maximum rated impact force.

9. A thumbwheel for use with a mobile device comprising:

an outer rim;

an inner hub; and a plurality of spokes extending between the outer rim and the inner hub, with each spoke including a spoke/rim joint and a spoke/hub joint that are not radially aligned with one another, wherein four pairs of spokes are provided, with each spoke within the pair being a mirror image of the other, and wherein each spoke shares a common spoke/rim and spoke/hub joint with another spoke.

10. A thumbwheel for use with a mobile device comprising:

an outer rim;

an inner hub having a center and an outer surface shape; and a plurality of spokes, each having a spoke body with a continuous curved shape extending between the outer rim and the inner hub, with each spoke having a length, width, depth, and shape for absorbing, along with the outer rim, a predetermined maximum impact force such that an applied force is not transmitted to the inner hub, and with each spoke further having a spoke body with a shape whose contour at least in part is arranged parallel to the outer surface of the inner hub.

11. The thumbwheel of claim 10, wherein the spoke body has a constant width, a spoke/rim joint, and a spoke/hub joint.

12. The thumbwheel of claim 11, wherein the spoke/rim joint and the spoke/hub joints are wider than the spoke body.

13. The thumbwheel of claim 11, wherein the spoke/rim joint and spoke/hub joint of each spoke are not radially aligned with one another.

14. The thumbwheel of claim 10, wherein the outer rim is resilient and the plurality of spokes are resilient.

15. The thumbwheel of claim 10, wherein the spokes are deformable in both a radial and a lateral direction relative to the outer surface of the hub.

16. The thumbwheel of claim 10, wherein each spoke has a first and a second sidewall, with the first sidewall being positioned farthest from the outer surface of the hub and the second side wall being positioned closest to the outer surface of the hub, with each of the first and second sidewalls having at least one of a portion that is parallel to the outer surface of the hub and a portion that is positioned in a non-radial plane.

17. The thumbwheel of claim 10, wherein each spoke has a first and a second sidewall, with the first sidewall being positioned farthest from the outer surface of the hub and the second side wall being positioned closest to the outer surface of the hub, with each of the first sidewalls extending substantially tangentially from the hub outer surface.

18. The thumbwheel of claim 10, wherein each of said spokes is sized and shaped to absorb a force that is greater than a maximum rated impact force.

19. A thumbwheel for use with a mobile device comprising:

an outer rim;

an inner hub; and a plurality of spokes extending between the outer rim and the inner hub, with each spoke having a length, width, depth, and shape for absorbing, along with the outer rim, a predetermined maximum impact force such that an applied force is not transmitted to the inner hub, wherein four pairs of spokes are provided, with each spoke within the pair being a minor image of the other, and wherein each spoke shares a common spoke/rim and spoke/hub joint with another spoke.

20. A thumbwheel for use with a mobile device comprising:

a single outer rim;

an inner hub having an outer surface; and a plurality of non-radially extending spokes coupled between the outer rim and the inner hub, with each spoke having a spoke/rim joint where the spoke mates with the rim and a spoke/hub joint where the spoke mates with the hub, wherein each spoke/rim joint does not overlap radially with each adjacent spoke's spoke/hub joint.

21. The thumbwheel of claim 20, wherein each spoke includes a spoke body having a constant width, a spoke/rim joint, and a spoke/hub joint.

22. The thumbwheel of claim 21, wherein the spoke/rim joint and the spoke/hub joints are wider than the spoke body.

23. The thumbwheel of claim 21, wherein the spoke/rim joint and spoke/hub joint of each spoke are not radially aligned.

24. The thumbwheel of claim 20, wherein the outer rim is resilient and the plurality of spokes are resilient.

25. The thumbwheel of claim 20, wherein the spokes are deformable in both a radial and a lateral direction relative to the surface of the hub.

26. The thumbwheel of claim 20, wherein each spoke has a length, width, depth, and shape that is designed to absorb a predetermined maximum impact force.

27. The thumbwheel of claim 20, wherein each spoke has a first and a second sidewall, with the first sidewall being positioned farthest from the outer surface of the hub and the second side wall being positioned closest to the outer surface of the hub, with each of the first and second sidewalls having a portion that is parallel to the outer surface of the hub.

28. The thumbwheel of claim 20, wherein each spoke has a first and a second sidewall, with the first sidewall being positioned farthest from the outer surface of the hub and the second side wall being positioned closest to the outer surface of the hub, with each of the first sidewalls extending substantially tangentially from the hub outer surface.

29. The thumbwheel of claim 20, wherein each of said spokes is sized and shaped to absorb a force that is greater than a maximum rated impact force.

30. A thumbwheel for use with a mobile device comprising:

an outer rim;

an inner hub; and a plurality of non-radially extending spokes coupled between the outer rim and the inner hub, wherein four pairs of spokes are provided, with each spoke within the pair being a mirror image of the other, and wherein each spoke shares a common spoke/rim and spoke/hub joint with another spoke.

* * * * *

UNITED STATES PATENT AND TRADEMARK OFFICE

CERTIFICATE OF CORRECTION

PATENT NO. : 7,304,254 B2
APPLICATION NO. : 11/437048
DATED : December 4, 2007
INVENTOR(S) : Ma et al.

It is certified that error appears in the above-identified patent and that said Letters Patent is hereby corrected as shown below:

Column 9, line 32, please replace "surface shape; and" with -- surface; and --

Column 9, line 35, please replace "continuous" with -- continuously --

Signed and Sealed this

Sixteenth Day of March, 2010

David J. Kappos

David J. Kappos
*Director of the United States Patent and Trademark Office*